United States Patent [19]

Valdemarsson

[11] Patent Number: 4,847,455

[45] Date of Patent: Jul. 11, 1989

[54] ELECTRIC SWITCHING DEVICE

[75] Inventor: Stefan Valdemarsson, Västerås, Sweden

[73] Assignee: Asea Brown Boveri AB, Västerås, Sweden

[21] Appl. No.: 171,441

[22] Filed: Mar. 21, 1988

[30] Foreign Application Priority Data

Mar. 25, 1987 [SE] Sweden ..... 8701230-8

[51] Int. Cl.[4] ..... H01H 33/20

[52] U.S. Cl. ..... 200/144 R; 361/14; 361/137

[58] Field of Search ..... 200/144 R, 146 R, 144 C; 361/14, 137

[56] References Cited

U.S. PATENT DOCUMENTS

| | | | |
|---|---|---|---|
| 2,816,990 | 12/1957 | Geczheiser | 200/144 C |
| 2,917,607 | 12/1959 | Sterling | 200/144 C |
| 3,032,627 | 5/1962 | Ronk | 200/146 R |
| 3,402,274 | 9/1968 | Bould | 200/146 R |
| 3,632,930 | 1/1972 | Parini | 200/146 R |
| 4,585,912 | 4/1986 | Fischer et al. | 200/144 R |
| 4,714,974 | 12/1987 | Schreurs et al. | 361/12 |

FOREIGN PATENT DOCUMENTS 1272423 7/1968 Fed. Rep. of Germany .

*Primary Examiner*—Robert S. Macon
*Attorney, Agent, or Firm*—Watson, Cole, Grindle & Watson

[57] ABSTRACT

The switching device has a fixed contact which cooperates with a movable contact secured to a movable contact carrier. The contacts are connected to runner rails for the arc that is created upon the contact opening. The runner rail connected to the movable contact consists of a movable commutating conductor which, during the initial stage of the contact opening, is at least approximately stationary, and then moves together with the movable contact to the open position of the switching device.

9 Claims, 3 Drawing Sheets

ELECTRIC SWITCHING DEVICE

TECHNICAL FIELD

The present invention relates to an electric switching device of the kind comprising a contact device with at least two cooperating contacts, at least one of which being movable between a closed and an open position, connection members for connecting the switching device into a circuit, and two runner rails which are each connected to a respective one of the two contacts, said runner rails being arranged such that the arc that is created upon contact opening, when current flows in the circuit, under the influence of the magnetic field generated by the current, is moved away from the contact device with the foot points of the arc running along the rails. The switching device may, for example, be a current limiting circuit breaker or a current limiter arranged in series with a circuit breaker, for example of the kind described in U.S. Pat. No. 4,714,974.

BACKGROUND ART

In current limiting switching devices of the above-mentioned kind, it is desirable that the arc leaves the contact material as quickly as possible and travels out on runner rails, which may, for example, be diverging to achieve a high arcing voltage, or which are adapted to insert a resistance into the circuit in order to limit the current.

In prior art switching devices operating in accordance with the above-mentioned principle, the arc commutation from the contacts to the runner rails has not taken place until a relatively large contact distance has been achieved and a relatively great amount of ionized gas has been formed at the front end of the runner rails. This deteriorates the current limiting ability of these devices.

In circuit breakers with separate main and break contacts it is known to arrange the movable break contact on a runner rail, which in turn is movably arranged in relation to the movable main contact (see e.g. German patent publication No. 1 272 423). In such a circuit breaker, a certain amount of time is required, on the one hand, for the current commutation from the main to the break contacts and, on the other hand, for the above-mentioned arc commutation from the break contacts to the runner rails.

SUMMARY OF THE INVENTION

The present invention aims to provide, in a switching device of the above-mentioned kind, a fast arc commutation from the contacts to the runner rails at the initial stage of a breaking operation, when the contact distance is relatively small. This is achieved according to the invention by designing the switching device so that the runner rail connected to the movable contact consists of or is connected to a movable commutating conductor which is so arranged that, during the initial stage of the contact opening, it is at least approximately stationary and then moves together with the movable contact to the open position.

By arranging a movable commutating conductor, which is practically stationary during the initial stage of the contact opening but which then moves together with the movable contact to the open position, a more rapid arc commutation is attained since a smaller volume needs to be ionized between the commutating conductor and the opposite runner rail. This results in reduced contact wear and in a faster voltage increase across the arc.

Suitable further improvements of the invention, and the particular advantages thereof, are clear from the subclaims and the embodiments described below.

BRIEF DESCRIPTION OF THE DRAWINGS

The invention will be described in greater detail with reference to a number of embodiments shown in the accompanying drawing, wherein.

DESCRIPTION OF THE PREFERRED EMBODIMENTS

Figure 1:
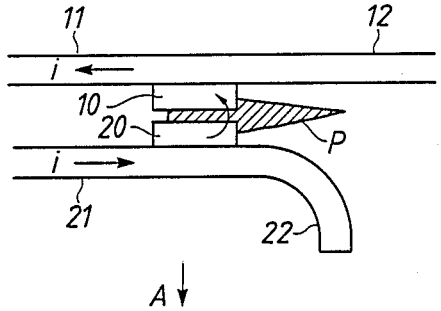
Fig. 1 PRIOR ART
FIG. 1 shows a schematic side view of a prior art contact device.

The prior art contact device shown in FIG. 1 comprises a fixed contact 10 secured to a fixed contact carrier 11, which contact cooperates with a movable contact 20 secured to a movable contact carrier 21. The fixed contact carrier 11 is connected to a fixed runner rail 12 and the movable contact carrier 21 is connected to a movable runner rail 22. The arrows designated i show the current direction through the contact device at a certain amount.

The movable contact 20 is movable between a closed position, in which it makes contact with the fixed contact 10, and an open position, in which it is situated at insulating distance from the fixed contact 10. Arrow A shows the direction of movement of the movable contact 20 during an opening movement. FIG. 1 shows the device at the initial stage of an opening movement, when the distance between the contacts 10, 20 is still small and an arc is burning therebetween.

A disadvantage of the embodiment shown in FIG. 1 is that it requires a relatively large contact distance before the plasma rays P from the arc make contact with the runner rails 12, 22 and the arc commutation to these can take place. This means that it takes a relatively long time before the arc leaves the contact region so that the current can be limited and, possibly, interrupted. During this time, considerable quantities of ionized gas and metal vapour will have time to form at the contacts, which renders the movement of the arc from the contact region still more difficult. In addition, burns on the contacts may easily occur.

Figure 2:
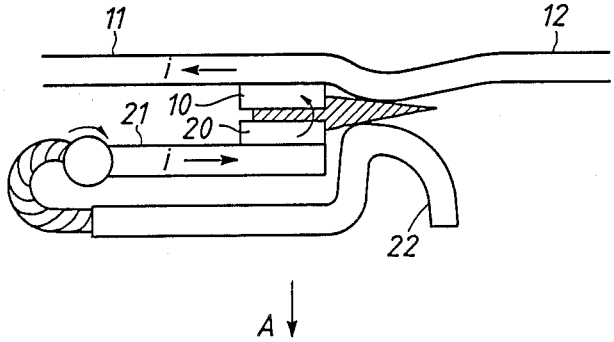
FIG. 2 shows in similar manner a contact device for a first embodiment of a circuit breaker constructed according to the invention.

The above-mentioned drawbacks can be considerably reduced by forming the runner rails as shown in FIG. 2, where the movable runner rail 22 is fixed at the beginning of the breaking operation and then, after the arc commutation, together with the movable contact 20, creates the necessary insulation distance. The advantage of this embodiment is that the plasma rays which arise at the initial stage can cause the current to commutate rapidly because of the slight volume that needs to be ionized between the runner rails. This leads to reduced contact wear and a sharper voltage increase across the arc.

Figure 3A:
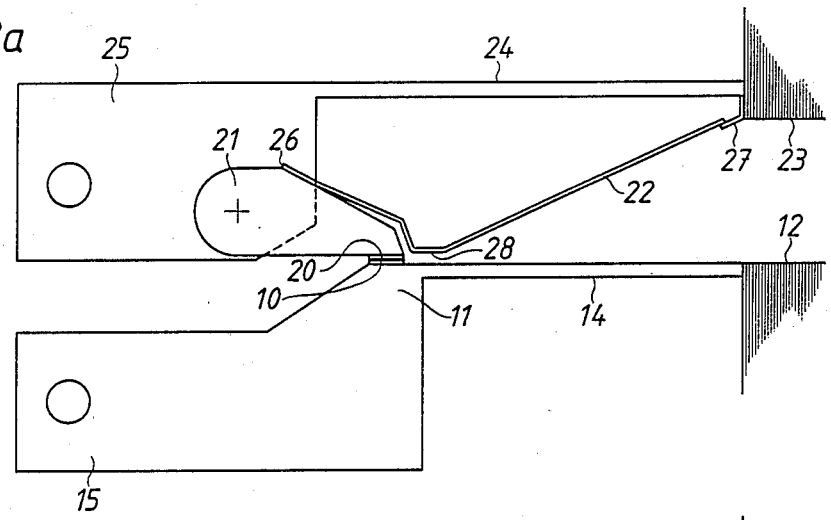
FIGS. 3*a*–3*c* show a contact device for a second embodiment of a circuit breaker, constructed according to the invention, in the closed position (FIG. 3*a*), at the initial stage of an opening operation (FIG. 3*b*), and in the open position (FIG. 3*c*)

In the switching device of which FIG. 3*a* shows a part, both the fixed contact 10 and the movable contact 20 are connected to fixed, resistive runner rails 12 and 23, respectively, of the kind described in the above-mentioned U.S. Pat. No. 4,714,974. The runner rails 12, 23 are connected, via connecting rails 14 and 24, respectively, to connection members 15 and 25, respectively, provided with apertures, for connecting the switching device into a circuit. The connection member 15 is formed integral with the contact carrier 11 for the fixed contact 10. The movable contact 20 is fixed to a contact carrier 21, which is rotatably journalled in the connection member 25 and electrically connected thereto by direct contact between the axis of rotation and the bearing surface of the contact carrier 11, where a relatively great contact force prevails in the closed position of the switching device. To prevent the occurrence of burns in the bearing surfaces when the contact force disappears in conjunction with the contact opening, a flexible connecting conductor (not shown) is arranged between the contact carrier 21 and the connection member 25. This conductor may be relatively thin since it need only carry current for a short period of time.

The rotatable contact carrier 21 is connected to the runner rail 23 via a commutating conductor 22 in the form of an elongated resilient sheet. One end of the commutating conductor 22 is fixed to the contact carrier 21 by means of a joint 26. The other end of the commutating conductor 22 is pressed by the action of the natural spring force of the conductor against a connection flap 27. To obtain as rapid an arc travelling as possible at the contact opening phase, it is important that not too great a part of the current is supplied to the arc via the conductors 24, 22, since a current in this path would influence the arc with a force in the wrong direction. In view of this, the electrical contact between the commutating conductor 22 and the flap 27 should not be too good. Therefore, these elements may possibly be separated by an insulating layer. To facilitate the arc commutation, the commutating conductor 22 is formed with a portion 28, located immediately in front of the contact 20 and projecting towards the connecting rail 14.

Figure 3B:
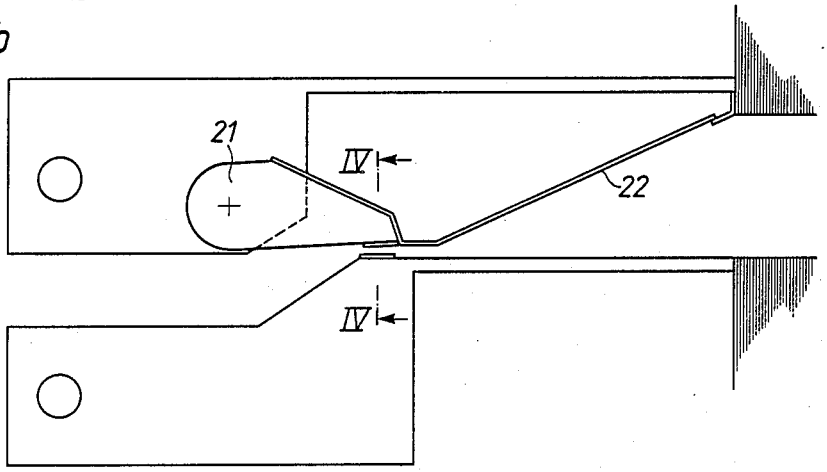
Figure 3C:
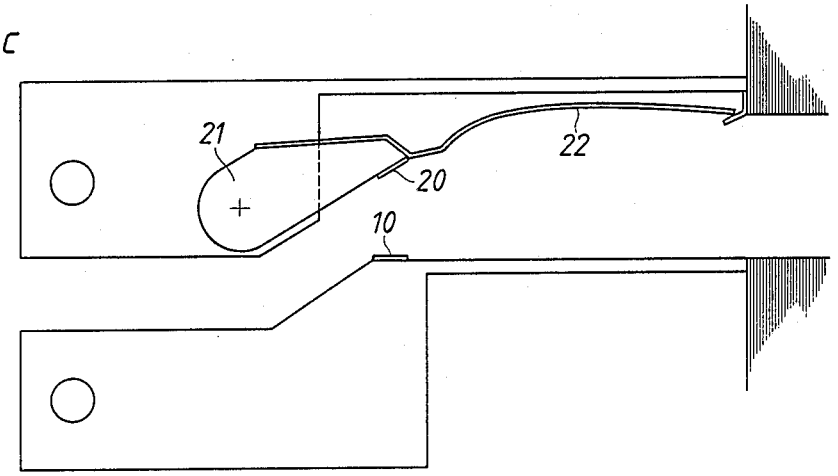

When a short-circuit occurs in the circuit into which the switching device is connected, the contact device 10, 20 is immediately opened by the influence of an automatically acting operating device (not shown in the Figure), which rotates the contact carrier 21 in a counter-clockwise direction. To be able rapidly to limit the current, it is very important that a contact gap of a certain minimum size (about 1 mm) is attained in the shortest possible time and that the arc thus created is rapidly removed from the contact surfaces. As will be clear from FIG. 3*a*, in the closed position of the switching device there is a certain distance between the commutating conductor 22 and the free end of the rotatable contact carrier 21. In this way it is prevented that the movable contact is slowed down by the commutating conductor 22 during the initial stage of the breaking operation to the position shown in FIG. 3*b*. During the first part of the breaking operation, the commutating conductor 22 is practically stationary. This facilitates the movement of the arc from the movable contact 20 to the projecting portion 28 on the commutating conductor 22 by the action of the magnetic field generated by the current. Thereafter, the arcing foot points move rapidly along the commutating conductor 22 and the connecting rail 14, respectively, to the resistive runner rails 23 and 12, whereby the current, during the continued movement of the arc, is rapidly limited. During the latter part of the opening movement, the commutating conductor 22 moves together with the contact carrier 21 to the open position shown in FIG. 3*c*, the free end of the conductor sliding against the contact flap 27.

The commutating conductor 22 will carry a high current for only a very short time, so its thickness can be relatively small (e.g. 1 mm).

Figure 4A:
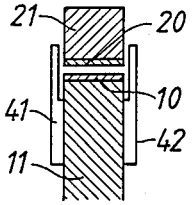
FIGS. 4*a* and 4*b* show a section along the line IV—IV in FIG. 3*b* according to a first and a second alternative, respectively.
Figure 4B:
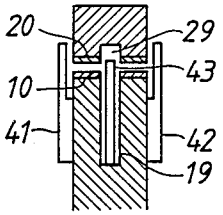

The movement of the arc from the contact surfaces can be further facilitated by arranging, on each side of the contact device, walls 41, 42 of such insulating material as gives off deionizing gas under the influence of the arc, as will be clear from FIG. 4*a*. In the example shown the walls are fixed on the side surfaces of the contact carrier 11 and project in front of the contact surface of the contact 10. A still faster arc commutation can be achieved if, in addition, as shown in FIG. 4*b*, a plate 43 of a material giving off gas is arranged in a recess 19, open towards the contact surface, in the fixed contact 10. Also this plate 43 projects in front of the contact surface of the fixed contact 10, and the movable contact 20 is therefore formed with a recess 29 adapted to the plate 43.

Figure 5:
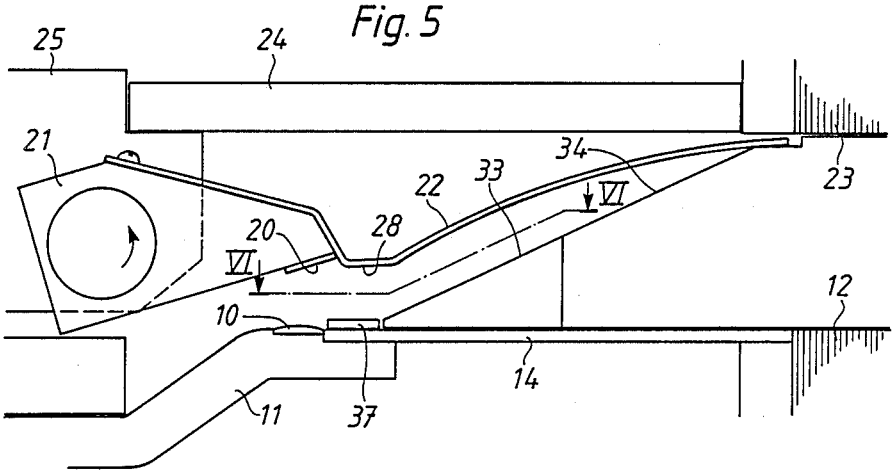
FIG. 5 shows a contact device for a third embodiment of a circuit breaker constructed according to the invention, in the open position.
Figure 6:
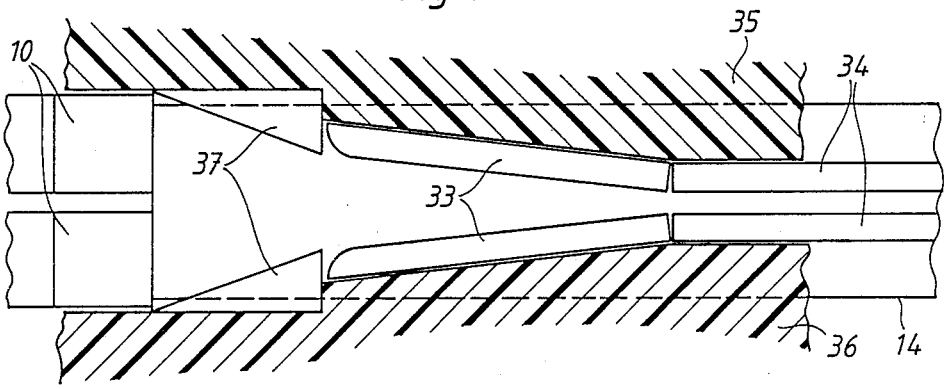
FIG. 6 shows a section along the line VI—VI in FIG. 5.

In the embodiment according to FIGS. 5 and 6, the connection flap 27 shown in FIG. 3*a* is omitted and instead the commutating conductor 22 rests against wedge-shaped plates 33, 34 of, for example, aluminium oxide ($A1_2O_3$), which form the inlet to a narrow gap for the arc between the runner rails 12, 23. The plates 33, 34 are arranged on the inside of walls 35, 36 of insulating material. At the orifice of the gap inlet, electrically insulating spacers 37 are arranged, with which the projecting portion 28 of the commutating conductor 22 makes contact in the closed position of the switching device, thus obtaining a fixed gap width of, for example, 1.5 mm between the commutating conductor 22 and the connecting rail 14. The spacers 37 may be made integral with the walls 35, 36. Because the free end of the commutating conductor 22, in the embodiment according to FIGS. 5 and 6, slides in under the end of the runner rail 23, the movement of the upper foot point of the arc from the commutating conductor 22 to the runner rail 23 is facilitated.

I claim:

1. An electric switching device comprising a contact device with at least two cooperating contacts, at least one of which being movable between a closed and an open position, connection members for connecting the switching device into a circuit, and two runner rails which are each connected to a respective one of the two contacts, said runner rails being arranged such that the arc that is created upon contact opening, when current flows in the circuit, under the influence of the magnetic field generated by the current, is moved away from the contact device with the foot points of the arc running along the rails, wherein that one of said runner rails which is connected to the movable contact consists of or is connected to a movable commutating conductor which is so arranged that, during the initial stage of the contact opening, it is at least approximately stationary and then moves together with the movable contact to the open position.

2. A switching device according to claim 1, wherein the commutating conductor (22) comprises an elongated resilient sheet, one end of which is fixed to the movable contact (20) and the other end of which is slidably connected to a fixed runner rail (23).

3. A switching device according to claim 2, wherein the commutating conductor (22) is formed with a portion (28) located in front of the movable contact (20) and projecting towards the opposite runner rail.

4. A switching device according to claim 1, further comprising walls (41, 42) of a material which gives off deionizing gas under the influence of the arc, said walls arranged on each side of the contact device.

5. A switching device according to claim 4, wherein the walls giving off gas are fixed on each side of the fixed contact (10) and project in front of the contact surface of said contact.

6. A switching device according to claim 4, further comprising a plate (43) of a material giving off gas when being heated, said plate arranged in a recess (19), open towards the contact surface, in one of the contacts.

7. A switching device according to claim 6, wherein the plate (43) which is arranged in a recess (19) in one of the contacts projects in front of the contact surface of said contact, the other contact having a recess (29) adapted to said plate.

8. A switching device according to claim 1, further comprising a gap between the runner rails, defined by means of wall elements (33, 34) of insulating material, for enclosing the arc, said wall elements forming supports for the commutating conductor (22) in the closed position of the switching device.

9. A switching device according to claim 3, further comprising a spacer (37), made of an insulating material, for the projecting portion (28) of the commutating conductor (22).

* * * * *